US011825925B2

(12) United States Patent
Thiebaud et al.

(10) Patent No.: US 11,825,925 B2
(45) Date of Patent: Nov. 28, 2023

(54) LUGGAGE COMPRISING TWO SECTIONS FOLDABLE BETWEEN A DEPLOYED USE CONFIGURATION AND A FOLDED STORAGE CONFIGURATION

(71) Applicant: DECATHLON, Villeneuve d'Ascq (FR)

(72) Inventors: Romain Thiebaud, Villeneuve d'Ascq (FR); Alexandre Guillon, Villeneuve d'Ascq (FR); Benoît Fray, Villeneuve d'Ascq (FR); Hélène Gosset, Villeneuve d'Ascq (FR); Romain Paupard, Villeneuve d'Ascq (FR)

(73) Assignee: DECATHLON, Villeneuve d'Ascq (FR)

( * ) Notice: Subject to any disclaimer, the term of this patent is extended or adjusted under 35 U.S.C. 154(b) by 0 days.

(21) Appl. No.: 17/839,577

(22) Filed: Jun. 14, 2022

(65) Prior Publication Data

US 2022/0395065 A1 Dec. 15, 2022

(30) Foreign Application Priority Data

Jun. 15, 2021 (FR) ..... 2106311

(51) Int. Cl.
*A45C 7/00* (2006.01)
*A45C 13/00* (2006.01)
*A45C 13/26* (2006.01)

(52) U.S. Cl.
CPC ..... *A45C 7/0054* (2013.01); *A45C 7/0036* (2013.01); *A45C 13/005* (2013.01); *A45C 13/262* (2013.01)

(58) Field of Classification Search
CPC ... A45C 7/0054; A45C 7/0036; A45C 13/005; A45C 13/262; A45C 5/14; A45C 7/0018; A45C 13/02

(Continued)

(56) References Cited

U.S. PATENT DOCUMENTS 1,150,057 A * 8/1915 O'Neill ..... A45C 7/0054 206/282
1,823,403 A * 9/1931 Krueger ..... A45C 3/004 190/110

(Continued)

FOREIGN PATENT DOCUMENTS

CN 207253007 U 4/2018
DE 202019003162 U1 * 10/2019 ..... A45C 7/00
WO WO-9408485 A1 * 4/1994 ..... A45C 3/004

*Primary Examiner* — John K Fristoe, Jr.
*Assistant Examiner* — Justin Caudill
(74) *Attorney, Agent, or Firm* — Murtha Cullina LLP

(57) ABSTRACT

The invention relates to a luggage with a shell having an upper section and a lower section connected by a hinge area. The upper section has a handle for handling the luggage with an upper framework between an upper handle and a lower support fastened in the upper section. The lower section has a lower framework which extends between a lower wall of the lower section and an upper support fastened in the lower section. The luggage being has an intermediate framework with a connector while being reversibly deployable between a position remote from the hinge area and a position of engagement of the connector into one of the supports while being arranged to prevent folding of the hinge area. The connector and the support includes a device for reversibly locking their engagement.

16 Claims, 3 Drawing Sheets

(58) Field of Classification Search
USPC ..... 190/109, 39, 115
See application file for complete search history.

(56) References Cited

U.S. PATENT DOCUMENTS

| | | | | | |
|---|---|---|---|---|---|
| 2,078,383 | A * | 4/1937 | Herzog | A45C 5/02 | 190/100 |
| 2,200,972 | A * | 5/1940 | Stein | A45C 13/005 | 190/123 |
| 2,341,104 | A * | 2/1944 | Kleber | A45C 13/03 | 190/13 F |
| 3,139,164 | A * | 6/1964 | Koffler | A45C 3/004 | 190/122 |
| 6,179,101 | B1 * | 1/2001 | Lin | A45C 13/262 | 280/37 |
| 8,453,896 | B1 * | 6/2013 | Mansell | A45F 3/04 | 223/89 |
| 8,567,578 | B2 * | 10/2013 | Cuong | A45C 13/24 | 190/110 |
| 9,375,063 | B2 * | 6/2016 | Chen | E05D 3/02 | |
| 2002/0139627 | A1 * | 10/2002 | Mahanavanont | A45C 3/004 | 190/115 |
| 2002/0148694 | A1 * | 10/2002 | Tong | A45C 3/004 | 190/110 |
| 2004/0007433 | A1 * | 1/2004 | Godshaw | A45C 7/0054 | 190/110 |
| 2019/0328097 | A1 * | 10/2019 | Kao | A45C 5/06 | |

* cited by examiner

[Fig.1a]
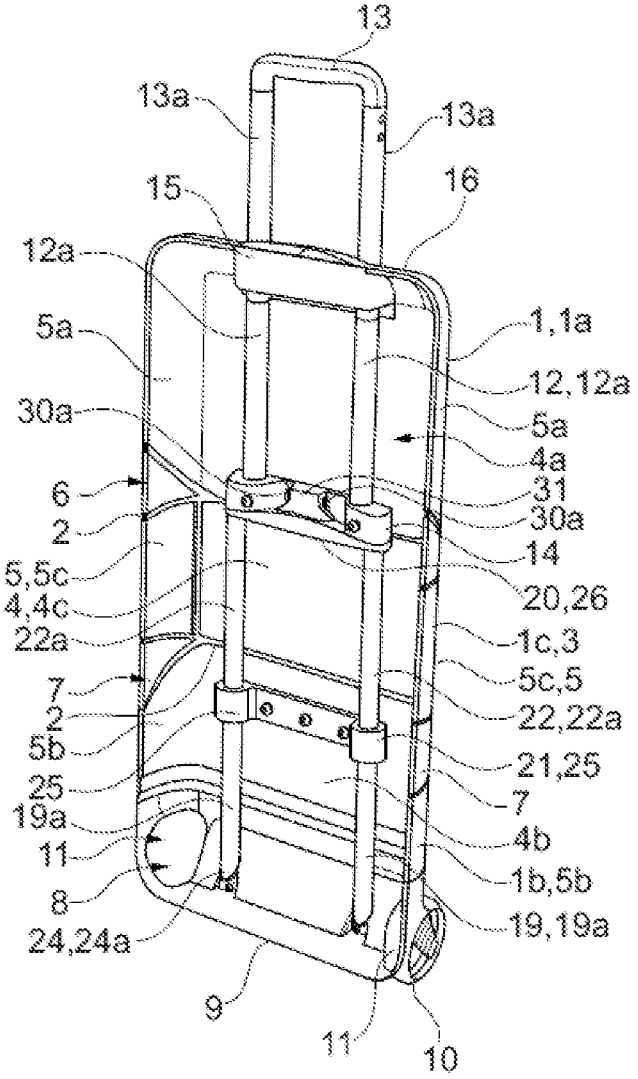
[Fig.1b]
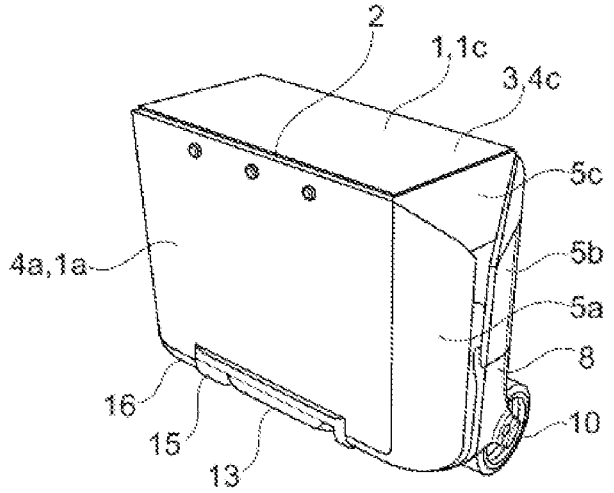

[Fig.2]
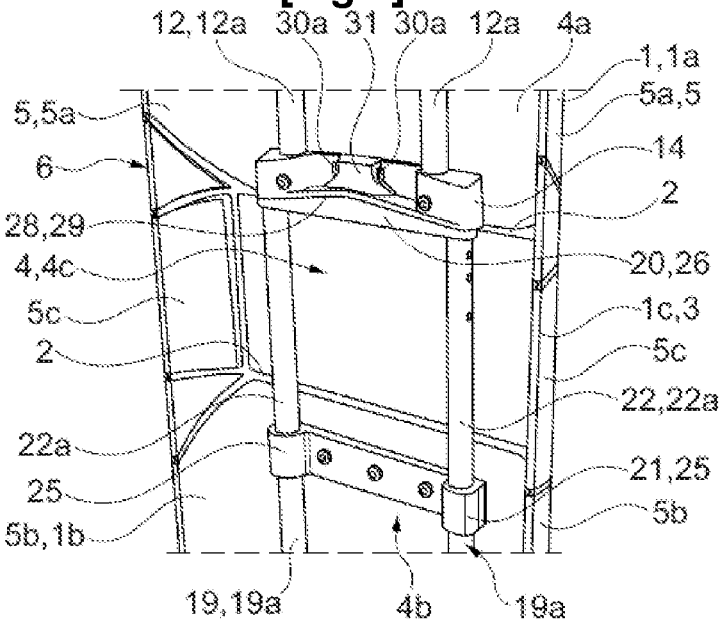
[Fig.3]
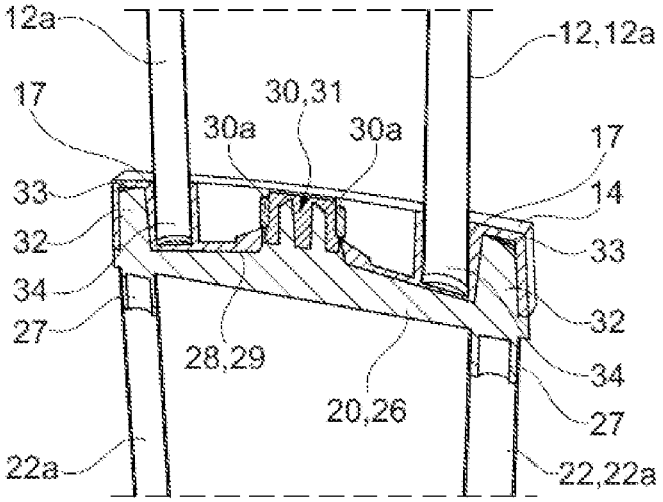

[Fig.4]
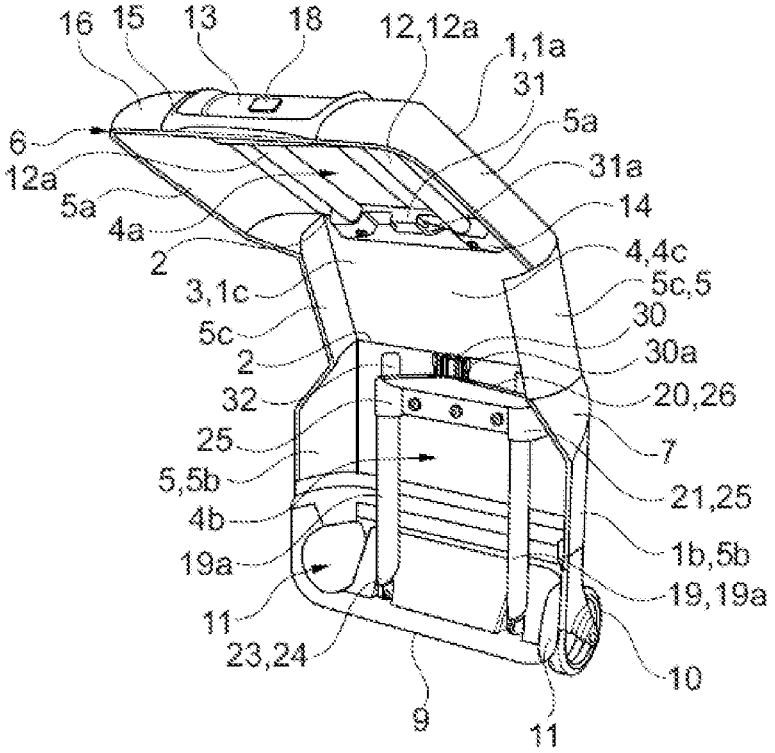
[Fig.5]
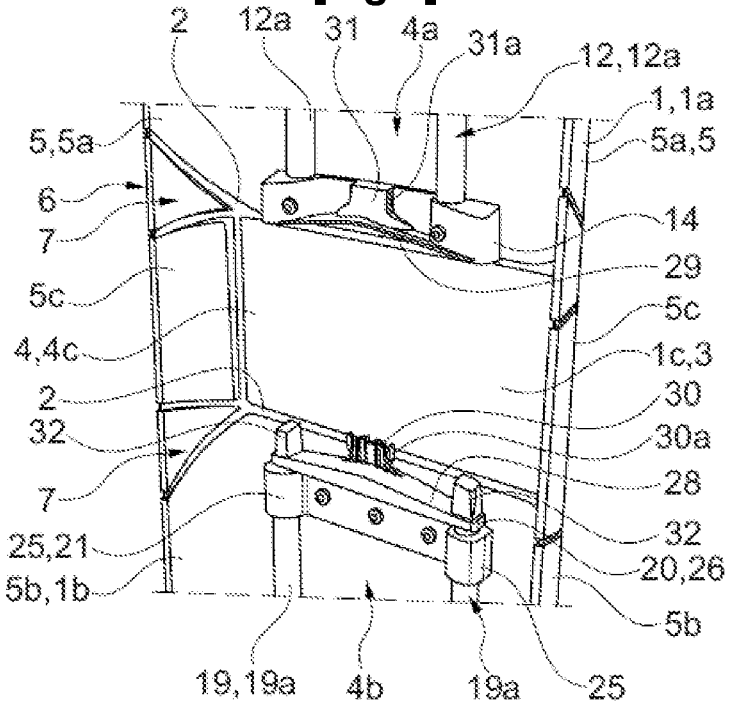

LUGGAGE COMPRISING TWO SECTIONS FOLDABLE BETWEEN A DEPLOYED USE CONFIGURATION AND A FOLDED STORAGE CONFIGURATION

CROSS-REFERENCE TO RELATED APPLICATION

This application claims the priority of French patent application number 2106311, filed on Jun. 15, 2021, the entire contents of which are incorporated herein by reference.

TECHNICAL FIELD

The invention relates to a luggage comprising a shell in which at least one storage compartment is formed.

Luggage comprising an upper shell and a lower shell connected by a hinge area adapted to enable the arrangement of said shells reversibly between a deployed configuration and a folded configuration of said luggage by folding of said hinge area are known.

The document CN-207 253 007 describes a luggage in which a hinge area is intended to form a stand bottom for said luggage in the folded configuration, one of the shells having a wall opposite to said bottom on which a gripping handle is affixed for handling said luggage.

In this document, each shell is equipped with two bars, two rods may be disposed between said bars over the hinge area to prevent folding thereof.

This solution is not fully satisfactory, in that handling of the rods proves to be relatively complex and barely intuitive to carry out to hold the luggage in the deployed configuration.

SUMMARY

The invention aims to improve the prior art by providing in particular a luggage wherein holding in the deployed configuration is achieved in a simple and intuitive manner, and that being so in a sufficiently reliable manner to secure the use of said luggage in said deployed configuration.

To this end, the invention provides a luggage comprising a shell in which at least one storage compartment is formed, said shell having an upper section and a lower section which are connected by a hinge area adapted to enable the arrangement of said sections reversibly between a deployed configuration of use of said compartment and a folded configuration of storage of said luggage by folding said hinge area, said upper section being equipped with a device for handling said luggage which comprises an upper framework extending between an upper handle projecting from said upper section and a lower support fastened in said upper section, the lower section being equipped with a lower framework which extends between a lower wall of said lower section and an upper support fastened in said lower section, said luggage being equipped with an intermediate framework which comprises a connector, said intermediate framework being reversibly deployable from one of the supports between a position remote from the hinge area and a position of engagement of the connector into the other one of the supports when the sections are in the use configuration, said intermediate framework in the engagement position being arranged so as to prevent folding of the hinge area, said connector and said other one of the supports comprising a device for reversibly locking their engagement in the use configuration of the luggage.

BRIEF DESCRIPTION OF THE DRAWINGS

Other particularities and advantages of the invention will appear from the following description, made with reference to the appended figures, wherein:

FIG. 1*a* and FIG. 1*b* represent, schematically and in perspective, a luggage according to an embodiment of the invention, respectively in the deployed (FIG. 1*a*) and folded (FIG. 1*b*) configuration;

FIG. 2 is an enlargement of FIG. 1*a* centred on the hinge area of the luggage;

FIG. 3 is a partial longitudinal sectional view of the association of the connector of the intermediate framework to the support of the upper framework of FIGS. 1*a* and 2;

FIG. 4 is a perspective representation of the luggage of FIGS. 1*a*, 2 and 3 upon arrangement thereof in the folded storage configuration;

FIG. 5 is a view similar to FIG. 2 in which the connector is dissociated from the support to enable the arrangement of the luggage in the folded configuration.

DETAILED DESCRIPTION

Referring to these figures, a luggage is described hereinbelow comprising a shell 1 in which at least one storage compartment is formed.

The shell 1 has an upper section 1*a* and a lower section 1*b* which are connected by a hinge area 3 adapted to enable the arrangement of said sections reversibly between a deployed configuration of use of the storage compartment (FIG. 1*a*) and a folded configuration of storage of said luggage (FIG. 1*b*), by folding said hinge area (FIG. 4).

In the description, the terms "front", "rear", "upper", "top", "lower" and "low" are considered with reference to the arrangement of the luggage as represented in FIGS. 1*a*, 2, 3, 4 and 5. Moreover, the terms "longitudinal" and "transverse" are considered with reference to the maximum dimension of the luggage in the deployed configuration (vertical in FIG. 1*a*), and refer to a direction respectively parallel and perpendicular to this dimension.

Advantageously, the shell 1 is formed in one-piece with the hinge area 3, in particular by thermoforming of a complex made of a polymer and/or textile material. This arrangement allows facilitating the manufacture of the luggage, and therefore deducing the costs thereof, but also making a light and solid shell 1, in order to limit the weight of said luggage.

The hinge area 3 comprises at least one transverse groove 2 enabling folding of the shell 1 on either side thereof. In particular, the groove 2 may be formed by means of complementary ribs intended to this end in the thermoforming dies used to make the shell 1.

In the represented embodiment, the hinge area 3 comprises a central section 1*c* which is connected on either side to the upper section 1*a* and the lower section 1*b* respectively through a fold groove 2.

Each section 1*a*, 1*b*, 1*c* has a rear bottom 4*a*, 4*b*, 4*c* and two lateral walls 5*a*, 5*b*, 5*c* which together form respectively a bottom 4 and lateral edges 5 for the storage compartment when the luggage is in the deployed configuration, each of the fold grooves 2 extending transversely on said bottom and said lateral edges.

In particular, each groove 2 has a central branch extending transversely on the bottom 4 of the shell 1, as well as two pairs of lateral branches which extend on each lateral edge 5 on either side of said central branch, in order to form a gusset 7 on said lateral edge to facilitate folding thereof (cf. FIGS. 4 and 1*b*).

The shell 1 is further equipped with a flexible flap (not represented) to enable the reversible closure of the storage compartment. The flexible flap may be associated to the front peripheral edge 6 of the shell 1 and may be equipped with a reversible closure means, for example in the form of a zipper closure which may extend along at least one portion of the peripheral edge 6.

In FIGS. 1*a*, 1*b* and 4, the lower section 1*b* has a reinforcing lower structure 8, in order to form a stand for the luggage. The lower structure 8 is affixed on the lower portion of the lower section 1*b*, in particular by moulding of a polymer material layer.

The reinforcing structure 8 comprises a lower wall 9 made of a rigid material, in order to ensure the stability of the luggage when said lower wall is arranged bearing against a support, in particular on the ground.

The lower wall 9 is equipped with rolling wheels 10 of the luggage, in order to enable a movement of said luggage in the use configuration by rolling on the ground.

In the represented embodiment, the lower wall 9 has two lateral wheels 10 directed towards the rear of the luggage, in order to limit the risks of tilting of said luggage, in particular when its storage compartment is heavily loaded.

In particular, each of the wheels 10 is disposed at least partially in a housing 11 intended to this end respectively on one side of the reinforcing structure 8. Thus, when the luggage stands upwards, the lower wall 9 bears on the ground at the front of the wheels 10, which allows limiting the risks of inadvertent rolling of the luggage.

The upper section 1*a* is equipped with a device for handling the luggage which comprises an upper framework 12 extending between an upper handle 13 projecting from said upper section and a lower support 14 fastened in said upper section.

The upper framework 12 comprises at least one bar 12*a* which extends between the lower support 14 and a base 15 of the upper handle 13, said base being associated throughout an upper wall 16 of the upper section 1*a*.

In the represented embodiment, the upper framework 12 comprises two bars 12*a* which are spaced apart transversely on the bottom 4*a* of the upper section 1*a*. In particular, each bar 12*a* has a lower end 34 which is fastened, in particular by fitting, in a tubular housing 17 intended to this end in the lower support 14 (cf. FIG. 3), as well as an upper end fastened to the base 15 of the handle 13 in a similar manner.

Moreover, as represented in FIG. 1*a*, the handle 13 has two rods 13*a* each of which is telescopically mounted respectively in one bar 12*a*.

The base 15 comprises a device for locking the handle 13 in the retracted position in the upper framework 12 and/or in at least one deployed use position, in order to avoid any inadvertent movement of said handle. In particular, the locking device could be deactivated by means of a button 18 intended to this end on the handle 13, as represented in FIG. 4, the user manually pressing said button to be able to move said handle in the desired position.

Thus, in order to be able to move the luggage in the use configuration, the user deploys the handle 13 out of the upper framework 12, and then makes said luggage tilt so as to bear on the wheels 10 by means of said handle, in order to make said luggage roll on the ground by pulling on said handle.

Advantageously, the lower support 14 is fastened, in particular by riveting, on the low of the upper section 1*a* in the vicinity of the upper edge of the hinge area 3, in order not to interfere with said edge upon folding of the luggage in the storage configuration.

The lower section 1*b* is equipped with a lower framework 19 which extends between the lower wall 9 of said lower section and an upper support 21 fastened in said lower section.

According to one embodiment, the lower framework 19 comprises at least one bar 19*a* which extends longitudinally between the lower wall 9 of the lower section 1*b* and the upper support 21.

In the represented embodiment, the lower framework 19 comprises two bars 19*a* which are spaced apart transversely on the bottom 4*b* of the lower section 1*b*, each bar 19*a* having a lower end 23 which is fastened, in particular by fitting, in a housing 24 intended to this end in the lower wall 9 of the reinforcing structure 8, as well as an upper end fastened in a tubular sleeve 25 of the upper support 21.

The luggage is equipped with an intermediate framework 22 which comprises a connector 20 said intermediate framework being reversibly deployable from the lower support 21 between a position remote from the hinge area 3 (FIGS. 4, 5) and a position of engagement of the connector 20 in the lower support 14 when the sections 1*a*, 1*b* are in the use configuration (FIGS. 1*a*, 2, 3), the intermediate framework 22 in the engagement position being arranged so as to prevent folding of the hinge area 3, said connector and said lower support comprising a device for reversibly locking their engagement in the use configuration of the luggage. Advantageously, the intermediate framework 22 is telescopically mounted in the lower framework 19.

Alternatively, the intermediate framework 22 may be reversibly deployable from the lower support 14 between a position remote from the hinge area 3 and a position of engagement of the connector 20 in the upper support 21.

In particular, the intermediate framework 22 is deployable in longitudinal translation so as to fit onto the support 14 of the framework 12 for deploying the handle, which forms an arrangement and a gesture that are particularly intuitive for the user.

Advantageously, the intermediate framework 22 has at least one rod 22*a* which is telescopically mounted in a bar 19*a* between a retracted position, in which said connector bears against the upper support 21 (FIGS. 4, 5), and a deployed position, in which the connector 20 is engaged in the lower support 14 and said rod covers the hinge area 3 so as to prevent folding thereof (FIGS. 1*a*, 2).

In particular, the intermediate framework 22 has two rods 22*a* each of which is telescopically mounted in respectively one bar 19*a*, said rods being spaced apart transversely on the bottom 4*c* of the hinge area 3 in the engagement position, in particular while allowing securing the use of the luggage in the deployed configuration.

The upper support 21 is fastened, in particular by riveting, on the top of the lower section 1*b* in the vicinity of the lower edge of the hinge area 3, in order not to interfere with said edge upon folding the luggage in the storage configuration.

The bars 12*a*, 19*a* and the rods 13*a*, 22*a* of each of the frameworks 12, 19, 22 are rigid, in particular by being made of a metallic material, which allows ensuring the stability of the luggage in the use configuration when it stands upright, as represented in FIG. 1*a*.

The connector 20 comprises a subplate 26 whose shape is arranged so as to fit into the lower support 14, said subplate carrying the means for locking the engagement of said connector in said upper support.

As represented in particular in FIG. 3, the subplate 26 has two lower lugs 27 each of which is fastened by fitting into the upper end of respectively a telescopic rod 22*a* of the intermediate framework 22, as well as an upper bearing surface 28 with a geometry complementary to that of a lower bearing surface 29 of the support 14, the locking means being formed on said upper bearing surface.

The locking device comprises at least one member 30/case 31 pair respectively associated to the connector 20 and to the lower support 14, said member being able to be reversibly fitted into said case and said pair having means 30*a*, 31*a* for reversibly immobilising said engagement.

In particular, the member 30 extends longitudinally at the centre of the upper bearing area 28 of the subplate 26 and has two elastic lateral legs 30*a* intended to reversibly fit respectively into a housing 31*a* formed to this end in the case 31, in order to ensure the reversible immobilisation of said member in said case. Thus, to be able to disengage the member 30 from the case 31, the user should pinch the legs 30*a* between two of his fingers to clear them from their respective housing 31*a*.

The locking device also comprises at least one member 32/housing 33 pair respectively associated to the connector 20 and to the lower support 14, said member could be reversibly engaged into the housing 33 while ensuring a stabilisation of said connector with respect to said support.

In the represented embodiment, the locking device comprise two member 32/housing 33 stabilisation lateral pairs disposed on either side of a member 30/case 31 central pair.

In particular, each stabilisation pair has a frustoconical member 32 extending longitudinally respectively from a transverse end of the upper bearing surface 28 of the subplate 26, while being arranged so as to reversibly interlock in a housing 33 with a complementary geometry formed respectively in a transverse end of the lower bearing surface 29 of the support 14.

To arrange the luggage in the storage configuration, the user dissociates the connector 20 from the lower support 14, in particular by pinching the lateral legs 30*a* of the member 30 to extract it from the case 31, and then makes the rods 22*a* slide in their respective bars 19*a* until bringing said connector in position against the upper support 21. Thus, the hinge area 3 is released from the rods 22*a*, which enables the user to fold the upper section 1*a* opposite the lower section 1*b*.

In particular, the upper 1*a* and lower 1*b* sections may be equipped with respective association means in the folded storage configuration (not represented), in order to avoid their relative rotation about the hinge area 3 in said storage configuration.

The luggage may also comprise a flap arranged to reversibly cover the frameworks 12, 19, 22 in order to isolate said frameworks from the storage compartment, and more particularly from the items that the user arranges in said compartment when using said luggage.

Thus, when he wishes to arrange the luggage in the storage configuration, the user could access the frameworks 12, 19, 22 and in particular the connector 20/support 14 set, by separating the flap from said frameworks after having emptied the storage compartment of said luggage.

The invention claimed is:

1. A luggage comprising a shell in which a storage compartment is formed, the shell having an upper section and a lower section which are connected by a hinge area configured to enable the arrangement of the sections reversibly between a deployed use configuration of the compartment and a folded configuration of storage of the luggage by folding the hinge area, the upper section being equipped with a handle for handling the luggage which comprises an upper framework extending between an upper handle projecting from the upper section and a lower support fastened in the upper section, the lower section being equipped with a lower framework which extends between a lower wall of the lower section and an upper support fastened in the lower section, the luggage further including an intermediate framework comprising a connector, the intermediate framework being reversibly deployable from one of the upper or lower supports between a position remote from the hinge area and an engagement position of the connector into the other one of the upper or lower supports when the upper and lower sections are in the use configuration, the intermediate framework in the engagement position being configured to prevent folding of the hinge area, the connector and the other one of the upper or lower supports comprising a locking device for reversibly locking the upper and lower supports in the use configuration of the luggage.

2. The luggage according to claim 1, wherein the shell is made in one-piece with the hinge area.

3. The luggage according to claim 1, wherein the hinge area comprises a transverse groove enabling folding on either side thereof.

4. The luggage according to claim 3, wherein the hinge area comprises a central section which is connected on either side to the upper section and the lower section respectively through a fold groove.

5. The luggage according to claim 1, wherein the upper framework comprises a bar which extends between the lower support and a base of the upper handle, the base being associated throughout an upper wall of the upper section.

6. The luggage according to claim 5, wherein the upper framework comprises two bars which are spaced apart transversely on the bottom of the upper section.

7. The luggage according to claim 5, wherein the upper handle has a rod which is telescopically mounted in the bar.

8. The luggage according to claim 1, wherein the lower support is fastened on the upper section in the vicinity of the upper edge of the hinge area.

9. The luggage according to claim 1, wherein the lower framework comprises the bar which extends between the lower wall of the lower section and the upper support.

10. The luggage according to claim 9, wherein the upper support is fastened on the top of the lower section in the vicinity of the lower edge of the hinge area.

11. The luggage according to claim 1, wherein the intermediate framework is telescopically mounted in the lower framework.

12. The luggage according to claim 11, wherein the intermediate framework has a rod which is telescopically mounted between a position of the connector against the upper support and a position of engagement of the connector into the lower support in which the rod covers the hinge area to prevent folding thereof.

13. The luggage according to claim 12, wherein the intermediate framework comprises two rods which are spaced apart transversely on the hinge area in the engagement position.

14. The luggage according to claim 1, wherein the connector comprises a subplate whose shape is configured to fit into the upper or lower support, the subplate carrying the locking device.

15. The luggage according to claim 1, wherein the locking device comprises a member and a case pair associated to the connector and to the support respectively, the member being able to be reversibly engaged into the case and being configured for reversibly immobilising the engagement.

16. The luggage according to claim 1, wherein the locking device comprises a member and a housing pair associated to the connector and to the support respectively, the member being able to be reversibly engaged into the housing while ensuring a stabilisation of the connector with respect to the support.

* * * * *